US011780477B2

(12) United States Patent
Cao et al.

(10) Patent No.: US 11,780,477 B2
(45) Date of Patent: Oct. 10, 2023

(54) RAIL VEHICLE AND COUPLING BOX THEREOF

(71) Applicant: CRRC ZHUZHOU LOCOMOTIVE CO., LTD., Hunan (CN)

(72) Inventors: Yuan Cao, Hunan (CN); Yangchun Min, Hunan (CN); Xihong Jin, Hunan (CN); Shangqiang Chen, Hunan (CN); Mingming Li, Hunan (CN)

(73) Assignee: CRRC ZHUZHOU LOCOMOTIVE CO., LTD., Hunan (CN)

( * ) Notice: Subject to any disclaimer, the term of this patent is extended or adjusted under 35 U.S.C. 154(b) by 625 days.

(21) Appl. No.: 16/978,671

(22) PCT Filed: Dec. 12, 2018

(86) PCT No.: PCT/CN2018/120584
§ 371 (c)(1),
(2) Date: Sep. 4, 2020

(87) PCT Pub. No.: WO2020/042430
PCT Pub. Date: Mar. 5, 2020

(65) Prior Publication Data

US 2021/0039689 A1 Feb. 11, 2021

(30) Foreign Application Priority Data

Aug. 30, 2018 (CN) ..... 201811003583.8
Aug. 30, 2018 (CN) ..... 201811004457.4

(51) Int. Cl.
*B61G 7/14* (2006.01)
*B61G 9/04* (2006.01)
*B61G 9/22* (2006.01)

(52) U.S. Cl.
CPC ..... *B61G 7/14* (2013.01); *B61G 9/04* (2013.01); *B61G 9/22* (2013.01)

(58) Field of Classification Search
CPC ..... B61G 7/14; B61G 9/04; B61G 9/22
See application file for complete search history.

(56) References Cited

U.S. PATENT DOCUMENTS

2008/0277366 A1 11/2008 Kemper
2010/0026020 A1 2/2010 Kwon et al.
(Continued)

FOREIGN PATENT DOCUMENTS

CN 102343918 A 2/2012
CN 202624260 U 12/2012
(Continued)

OTHER PUBLICATIONS

International Search Report for PCT/CN2018/120584 dated Apr. 15, 2019, ISA/CN.
(Continued)

*Primary Examiner* — Robert J McCarry, Jr.
(74) *Attorney, Agent, or Firm* — Yue (Robert) Xu; Apex Attorneys at Law, LLP

(57) ABSTRACT

A coupling box of a rail vehicle, including a fixed portion fixedly mounted on a vehicle body and a movable portion connecting to a coupler and draft gear; the movable portion is connected to an inner end of the fixed portion by means of a constant-force connecting member, the constant-force connecting member is broken when the coupler and draft gear pushes the movable portion to move inwardly at the time of a collision, so that the movable portion and the fixed portion are able to be separated from each other.

14 Claims, 6 Drawing Sheets

(56) References Cited

U.S. PATENT DOCUMENTS

| | | | |
|---|---|---|---|
| 2015/0114921 | A1 | 4/2015 | Chen et al. |
| 2018/0093681 | A1 | 4/2018 | Kroiss et al. |

FOREIGN PATENT DOCUMENTS

| | | | | | |
|---|---|---|---|---|---|
| CN | 202684423 | U | | 1/2013 | |
| CN | 103085835 | A | | 5/2013 | |
| CN | 103625502 | A | | 3/2014 | |
| CN | 104149811 | A | | 11/2014 | |
| CN | 106364522 | A | | 2/2017 | |
| CN | 106379368 | A | * | 2/2017 | ..... B61G 9/04 |
| CN | 106379368 | A | | 2/2017 | |
| CN | 206171492 | U | | 5/2017 | |
| CN | 106809240 | A | | 6/2017 | |
| CN | 206344830 | U | | 7/2017 | |
| CN | 107176180 | A | | 9/2017 | |
| CN | 207274709 | U | | 4/2018 | |
| CN | 108248630 | A | | 7/2018 | |
| DE | 202004014532 | U1 | | 2/2006 | |
| FR | 2789038 | A1 | | 8/2000 | |
| KR | 20110096300 | A | | 8/2011 | |
| KR | 20180076379 | A | | 7/2018 | |

OTHER PUBLICATIONS

First Examination Report dated Jun. 2, 2021 for Australian patent application No. 2018439289.

Decision of Rejection dated Feb. 6, 2020 for Chinese patent application No. 201811004457.4, English translation provided by machine translation.

* cited by examiner

RAIL VEHICLE AND COUPLING BOX THEREOF

This application is a National Phase entry of PCT Application No. PCT/CN2018/120584, filed on Dec. 12, 2018, which claims the benefit of priorities to Chinese Patent Application No. 201811003583.8, titled "RAIL VEHICLE AND COUPLING BOX THEREOF", filed with the China National Intellectual Property Administration on Aug. 30, 2018, and Chinese Patent Application No. 201811004457.4, titled "RAIL VEHICLE AND COUPLING BOX THEREOF", filed with the China National Intellectual Property Administration on Aug. 30, 2018, the entire disclosures of which are incorporated herein by reference.

FIELD

The present application relates to the field of rail vehicles, and particularly to a coupler box of a rail vehicle. Furthermore, the present application also relates to a rail vehicle including the coupler box.

BACKGROUND

With the development of rail technology, a vehicle passive safety is more and more important. The energy absorption structure of a collision resistant locomotive body mainly includes a multi-level energy absorption structure such as a coupler buffer device, the vehicle body end structure and the like. The multi-level energy absorption structure is applied based on the premise that the multi-level energy absorption structure such as the coupler buffer device, the vehicle body end structure and the like can absorb the energy sequentially and controllably; that is, when two vehicles collide, the coupler buffer device moves backward to absorb the energy, and after the energy absorption of the coupler buffer device is completed, the installation structure of the coupler buffer device fails, and the next level of energy absorption component is in contact, so that the next level of energy absorption component is triggered to absorb energy.

At present, in this kind of coupler box of the coupler buffer device, however, in the case of a short coupler length and a high strength, the installation structure of the coupler buffer device will not fail or be difficult to fail after the energy absorption of the coupler buffer device is completed when a vehicle collision occurs. The coupler buffer device after absorbing energy will hinder the contact of the next level of energy absorption device, so that the next level of energy absorption device cannot be triggered to absorb energy.

Therefore, in order to improve the locomotive crashworthiness of the coupler buffer device with a coupler yoke, a problem that avoids the next level of energy absorption device from being hindered needs to be solved, which may otherwise be triggered to absorb energy, due to a not-failure of the installation structure of the coupler buffer device or a difficulty to make the installation structure of the coupler buffer device fail when a vehicle collision occurs.

SUMMARY

An object of the present application is to provide a coupler box of a rail vehicle, and a fixing portion is connected with a movable member by a constant-force connector. The constant-force connector can be broken when a vehicle collision occurs, and the subsequent energy absorption elements of the multi-level energy absorption begin to deform and absorb the energy, so as to realize a controllable sequential energy absorption of the multi-level energy absorption structure at an end of the vehicle. Another object of the present application is to provide a rail vehicle including the coupler box.

In order to solve the technical problem, the present application provides a coupler box of the rail vehicle, which includes a fixing portion fixedly installed on a vehicle body and a movable portion connected with a coupler buffer device, the movable portion is connected with an inner end of the fixing portion through a constant-force connector, and the constant-force connector is configured to be broken during the inward movement of the movable portion pushed by the coupler buffer device when the vehicle collides, so that the movable portion and the fixing portion are able to be separated from each other.

Preferably, the fixing portion includes two box bodies symmetrically arranged on two sides of a longitudinal center line of the vehicle body and a bottom plate for covering an opening at the bottom of the box body. A space for passing through the coupler buffer device is provided between the two box bodies. Multiple mounting holes for connecting the constant-force connector are provided in an inner end side wall of each box body.

Preferably, the bottom plate includes a transition plate and two cover plates which are integrally formed, the two cover plates cover the openings at the bottom of the two box bodies respectively, and the transition plate is connected with inner ends of the two cover plates.

Preferably, the movable portion includes an end plate. Multiple mounting holes for connecting the constant-force connector are provided at the two sides, correspond to the inner ends of the two box bodies, on the end plate. A protrusion is provided on an outer end of the end plate, which can be installed in the space of the two box bodies and is connected with the coupler buffer device.

Preferably, the constant-force connector is specifically multiple constant-force bolts passing through the mounting hole. Extending directions of the constant-force bolts is parallel to a longitudinal center line of the vehicle body, and the multiple mounting holes in the inner end side wall of each box body and at two sides of the end plate are sequential arranged along a vertical direction.

Preferably, a threaded plate threadedly connected with an end of the constant-force bolt is provided inside each box body, and the threaded plate abut against the inner end side wall of the box body, and a pad is provided between a head of the constant-force bolt and an inner end of the end plate.

Preferably, a square hole for the access of the threaded plate is provided at a position, corresponding to the threaded plate, of the cover plate, and a falling prevention plate for covering the square hole is detachably installed on the bottom plate.

Preferably, a safety rope is also included, and two ends of the safety rope are respectively connected with the movable portion and the fixing portion.

Preferably, the safety rope is detachably connected with the movable portion and the fixing portion through a pin shaft and a cotter pin.

The present application provides the coupler box of the rail vehicle, which includes the mounting base fixedly installed at the bottom of the vehicle body and the box body connected with the coupler buffer device. The box body is connected with the mounting base through a constant-force connector. The constant-force connector is configured to be broken during the inward movement of the box body pushed by the coupler buffer device when the vehicle collision occurs, so that the box body and the mounting base may be separated from each other. A sliding groove extending in the longitudinal direction is provided at the bottom of the vehicle body, and a top of the box body is connected with a sliding member installed in the sliding groove. The sliding member can move along the extending direction of the sliding groove, and the sliding groove can prevent the sliding member from falling.

Preferably, two mounting bases symmetrically arranged on two sides of a longitudinal center line of the vehicle body are included, the box body is installed between the two mounting bases, and a connecting plate for connecting the constant-force connector is symmetrically provided on the two sides of the box body.

Preferably, the mounting base on each side includes an outer vertical plate and an inner vertical plate which are arranged successively along the longitudinal direction of the vehicle body, the outer vertical plate and the inner vertical plate are connected with a support beam, mounting holes for connecting the constant-force connector are provided on the outer vertical plate and the inner vertical plate, and the connecting plate on each side includes an outer connecting plate and an inner connecting plate which are arranged successively along the longitudinal direction of the vehicle body. And mounting holes for connecting the constant-force connector are provided on the outer connecting plate and the inner connecting plate respectively corresponding to the outer vertical plate and the inner vertical plate on the same side.

Preferably, the constant-force connector is specifically a plurality of constant-force bolts passing through the mounting holes, the extending direction of the constant-force bolts is parallel to the longitudinal center line of the vehicle body, and the plurality of mounting holes in the outer vertical plate, the inner vertical plate, the outer connecting plate and the inner connecting plate are successively arranged along a vertical direction.

Preferably, an adjusting gasket is arranged between the outer vertical plate and the outer connecting plate, and between the inner vertical plate and the inner connecting plate.

Preferably, two impact seats are provided on an outer end of the box body.

Preferably, the sliding groove is specifically a C-shaped groove with an opening downward, the sliding member is specifically a T-shaped beam extending in the longitudinal direction of the vehicle body, a vertical portion of the T-shaped beam is connected with the box body, and a horizontal portion of the T-shaped beam is installed in the C-shaped groove.

Preferably, the two C-shaped grooves and two corresponding T-shaped beams symmetrically arranged on two sides of the longitudinal center line of the vehicle body are included, and each T-shaped beam includes an outer beam and an inner beam successively arranged along the longitudinal direction of the vehicle body.

Preferably, an outer notch and an inner notch for the outer beam and the inner beam to enter the C-shaped groove horizontally are provided on the same side of the two C-shaped groove.

The present application provides a rail vehicle, including a vehicle body and a coupler box installed on a front of a vehicle. The coupler box is specifically a coupler box according to any one of the above described.

The present application provides a coupler box of a rail vehicle, which includes a fixing portion installed on the vehicle body and a movable portion connected with the coupler buffer device. The movable portion is connected with an inner end of the fixing portion through a constant-force connector. The constant-force connector is configured to be broken when the vehicle collides during the movement inward of the movable portion pushed by the coupler buffer device, so that the movable portion and the fixing portion may be separated from each other. When the vehicle travels normally, a tensile force and a compressive force of the coupler buffer device are transmitted to the vehicle body through the coupler box, the tensile force and the compressive force of the coupler buffer device are suffered by the coupler box; when the rail vehicle collision occurs, after the initial energy absorption of the coupler buffer device is completed, in a case that the contact force is greater than the preset tensile force of the constant-force connector, the constant-force connector is broken, and the movable portion of the coupler box continues moving inward, so that the whole coupler buffer device moves inward, the subsequent energy absorption elements of multi-level energy absorption begin to deform and absorb the energy, so as to realize the controllable sequential energy absorption of the multi-level energy absorption structure at the end of the vehicle, improve the crashworthiness of the rail vehicle with the coupler buffer device, avoid the next level of energy absorption device from being hindered, which may otherwise be triggered to absorb energy, due to a not-failure of the installation structure of the coupler buffer device or a difficulty to make the installation structure of the coupler buffer device fail when trains collide with each other, and improve the safety of equipment.

The present application provides a coupler box of a rail vehicle, which includes a mounting base fixedly installed at the bottom of a vehicle body and a box body connected with the coupler buffer device. The box body is connected with the mounting base through a constant-force connector. The constant-force connector is configured to be broken when the vehicle collides during the movement inward of the box body pushed by the coupler buffer device, so that the box body and the mounting base are able to be separated from each other. A sliding groove extending in the longitudinal direction is provided at the bottom of the vehicle body, and a top of the box body is connected with a sliding member installed in the sliding groove. The sliding member can move along the extending direction of the sliding groove, and the sliding groove can prevent the sliding member from falling.

When the vehicle travels normally, a tensile force and a compressive force of the coupler buffer device are transmitted to the vehicle body through the coupler box, the tensile force and the compressive force of the coupler buffer device are borne by the coupler box; when the rail vehicle collides, after the initial energy absorption of the coupler buffer device is completed, in a case that a contact force is greater than a preset tensile force of the constant-force connector, the constant-force connector is broken, and the box body of the coupler box continues moving inward along the sliding groove, so that the whole coupler buffer device moves inward, the subsequent energy absorption elements of multi-level energy absorption begin to deform and absorb the energy, so as to realize the controllable sequential energy absorption of the multi-level energy absorption structure at the vehicle end. The coupler box has a simple structure and is easy to realize, meets the collision standard, ensures the personal safety of drivers and passengers, improves the crashworthiness of the rail vehicles with the coupler buffer device, and avoid the next level of energy absorption device from being hindered, which may otherwise be triggered to absorb energy, due to a not-failure of the installation structure of the coupler buffer device or a difficulty to make the installation structure of the coupler buffer device fail when trains collide with each other, and improves the safety of equipment.

A rail vehicle including the coupler box is further provided according to the present application. Since the coupler box has the above technical effects, the rail vehicle also has the same technical effects, which will not be described in detail herein again.

DETAILED DESCRIPTION OF THE EMBODIMENTS

A core of the present application is to provide a coupler box of a rail vehicle. A fixing portion is connected with a movable portion through a constant-force connector, the constant-force connector can be broken when a vehicle collision occurs, and subsequent energy absorption elements of the multi-level energy absorption begin to deform and absorb the energy, so as to realize a controllable sequential energy absorption of the multi-level energy absorption structure at an end of the rail vehicle. Another object of the present application is to provide a rail vehicle including the coupler box.

In order to make the person skilled in the art have a better understanding of solutions of the present application, the present application is described in further detail hereinafter, in conjunction with the drawings and embodiments.

Figure 1:
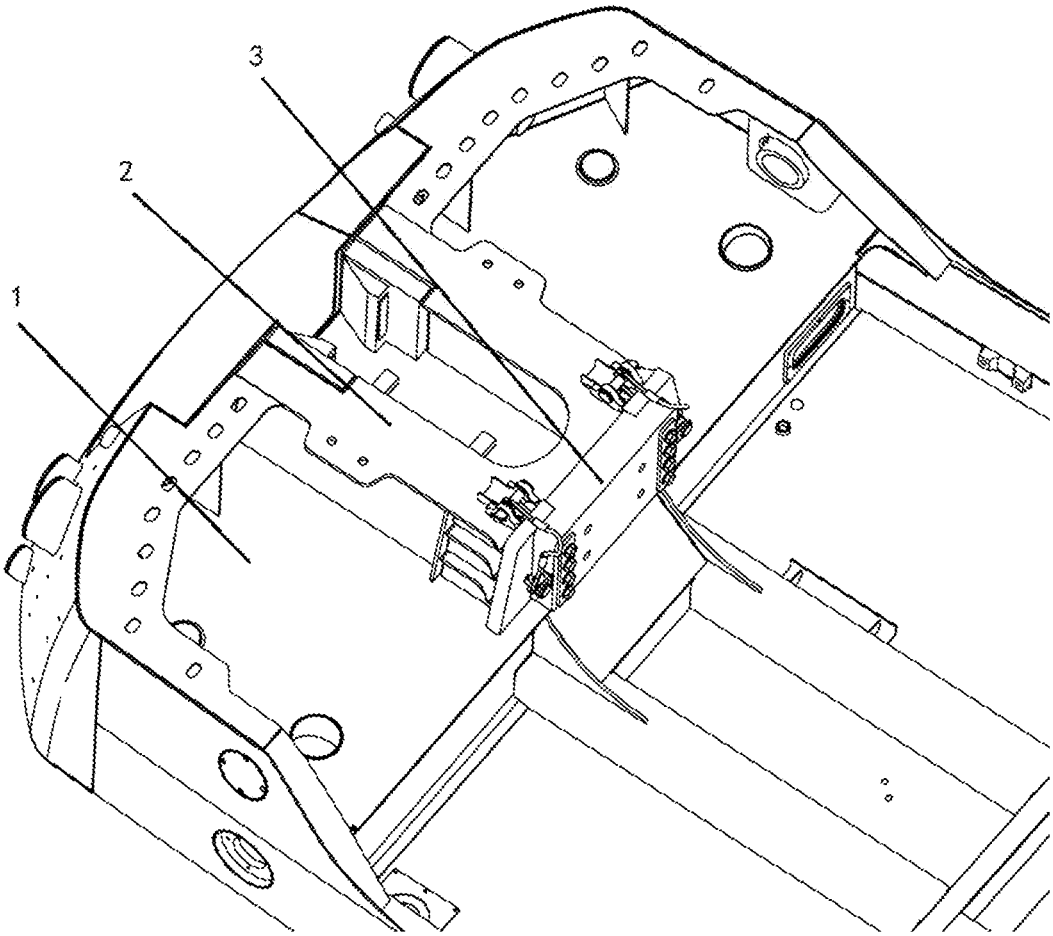
FIG. 1 is a schematic structural view of a specific embodiment of a coupler box according to the present application.
Figure 2:
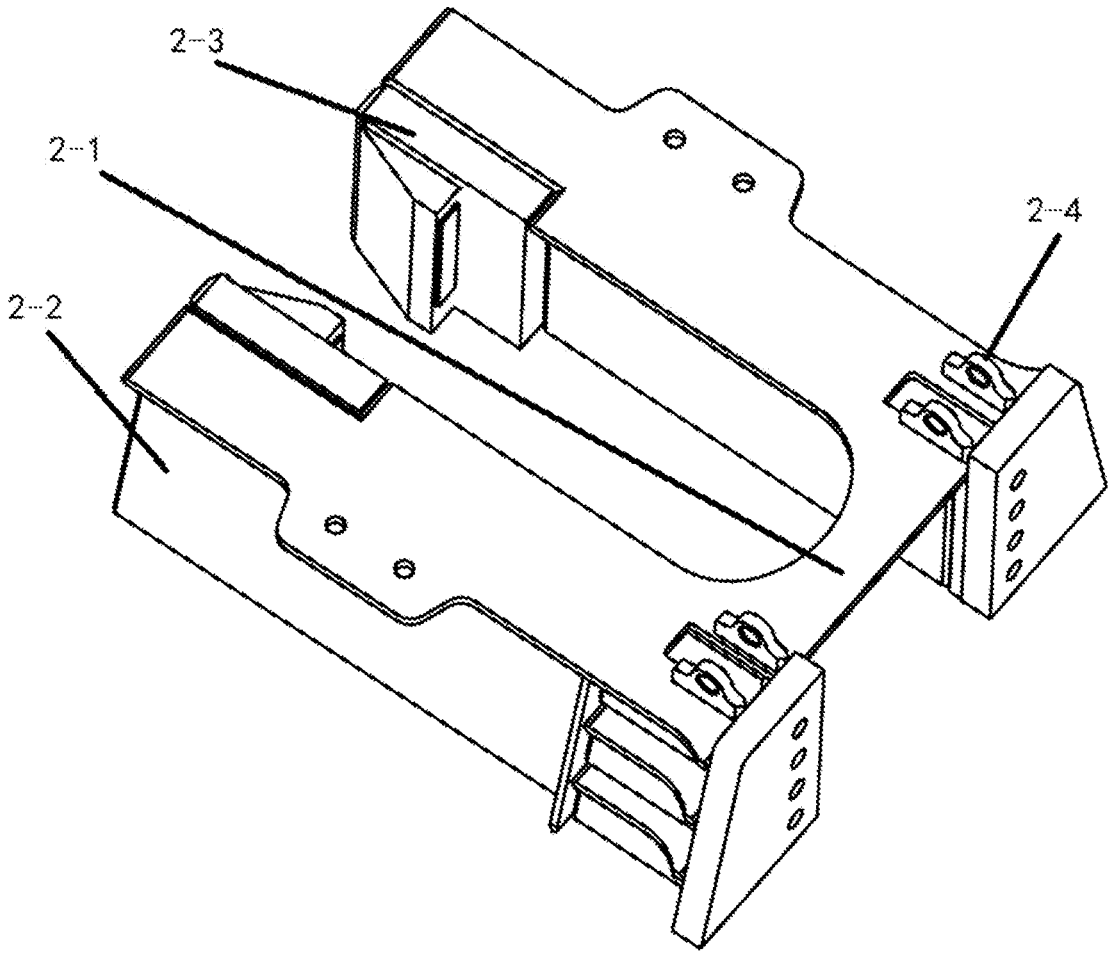
FIG. 2 is a schematic structural view of a fixing portion in the specific embodiment of the coupler box according to the present application.
Figure 3:
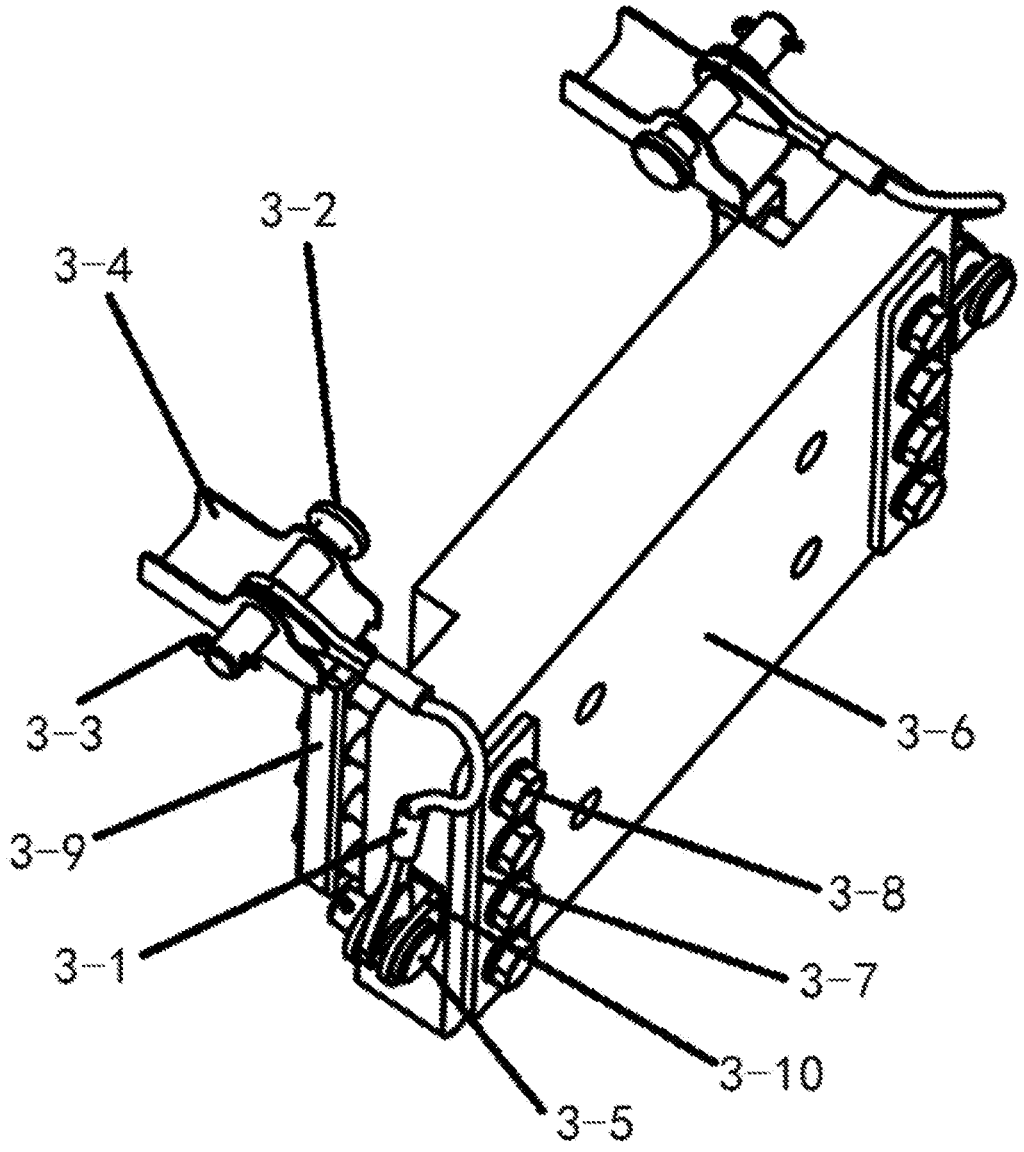
FIG. 3 is a schematic structural view of a movable portion in the specific embodiment of the coupler box according to the present application.
Figure 4:
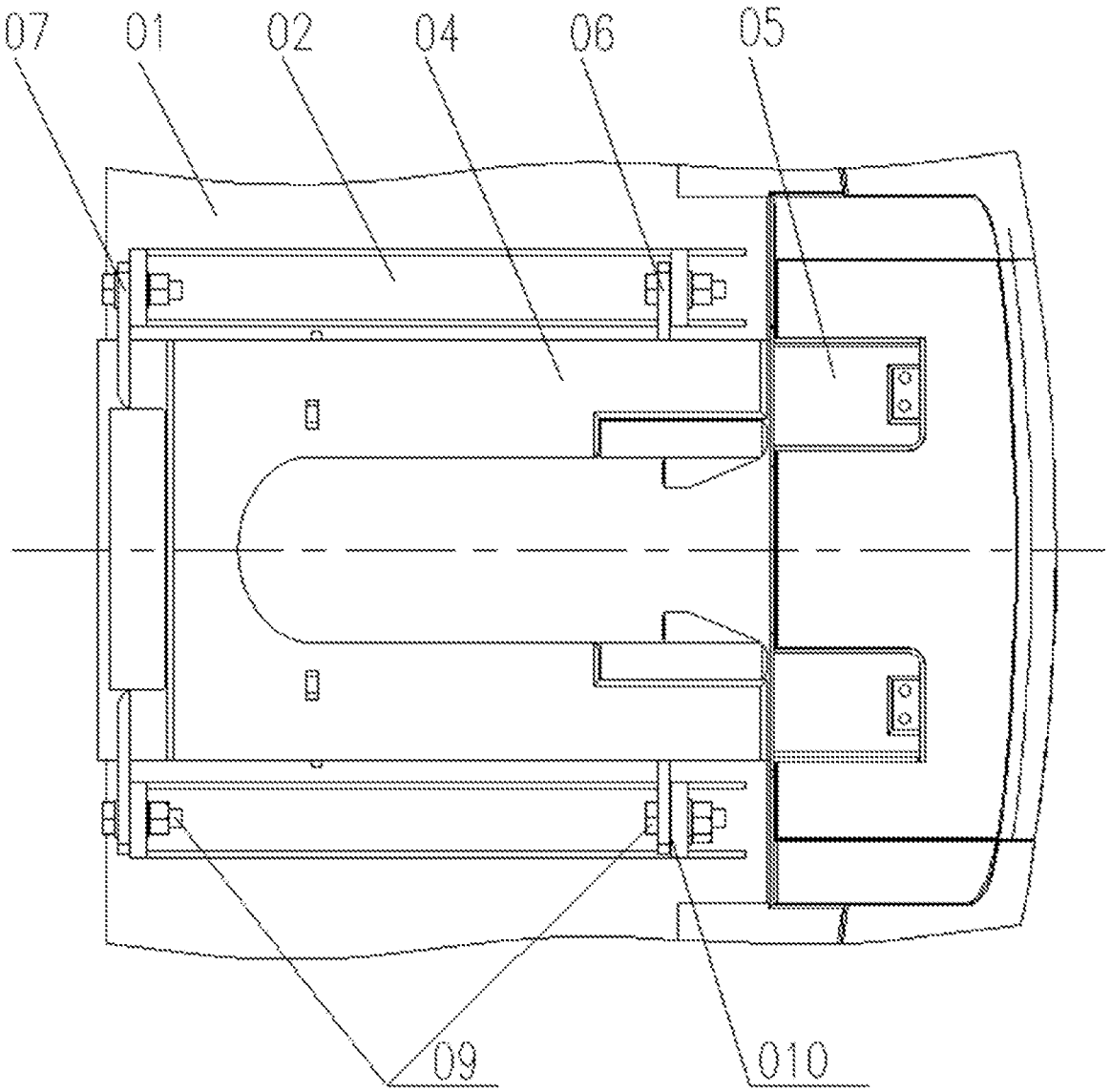
FIG. 4 is a bottom view of the specific embodiment of the coupler box according to the present application.

Referring to FIGS. 1 to 3, FIG. 1 is a schematic structural view of a specific embodiment of a coupler box according to the present application; FIG. 2 is a schematic structural view of a fixing portion in the specific embodiment of the coupler box according to the present application; and FIG. 3 is a schematic structural view of a movable portion in the specific embodiment of the coupler box according to the present application.

A coupler box of a rail vehicle is provided according to a specific embodiment of the present application, which includes a fixing portion 2, a movable portion 3 and a constant-force connector. The fixing portion 2 is fixedly installed on the bottom of a vehicle body 1, the movable portion 3 is connected with the coupler buffer device. The constant-force connector is connected with the movable portion 3 and an inner end of the fixing portion 2 respectively, and the constant-force connector can be broken after a tensile force suffered by the constant-force connector is greater than a preset pressure force. An end of each component toward the end of the vehicle body 1 is defined as an outer end, and an end toward the middle of the vehicle body 1 is defined as an inner end.

When the vehicle travels normally, a tensile force of the coupler buffer device is transmitted to the vehicle body 1 through the fixing portion 2, and a compressive force of the coupler buffer device is transmitted to the vehicle body 1 through the movable portion 3, the constant-force connector and the fixing portion 2 in a listed sequence. At this time, the tensile force suffered by the constant-force connector is smaller than the preset pressure force, and the components are in a normal connection state, and the tensile force and the compressive force of the coupler buffer device are suffered by the coupler box.

When a vehicle collision occurs, after an initial energy absorption of the coupler buffer device is completed, the movable portion 3 is continually pushed to move inward by transmitting the force to the constant-force connector. In the case that a contact force is greater than a preset tensile force of the constant-force connector, the constant-force connector is broken, and the movable portion 3 of the coupler box continues moving inward, so that the movable portion 3 and the fixing portion 2 are separated from each other, and the coupler buffer device as a whole moves inward. The subsequent energy absorption elements of multi-level energy absorption begin to deform and absorb the energy, so as to realize the controllable sequential energy absorption of the multi-level energy absorption structure at an end of the vehicle, improve the crashworthiness of the rail vehicle having the coupler buffer device, avoid the next level of energy absorption device from being hindered, which may otherwise be triggered to absorb energy, due to a not-failure of the installation structure of the coupler buffer device or a difficulty to make the installation structure of the coupler buffer device fail when a vehicle collision occurs, and improve the safety of the equipment.

Specifically, in order to facilitate the installation of each component and balance the force, the fixing portion 2 includes two box bodies 2-2 which are symmetrically arranged on two sides of a longitudinal center line of the vehicle body 1, and the bottom of the box body 2-2 is provided with an opening. The bottom herein refers to a downward side when the vehicle is placed normally. At the same time, a bottom plate 2-1 is provided to cover the opening at the bottom of the two box bodies 2-2, so that the two box bodies 2-2 form a relatively closed structure. A space is provided between the two box bodies 2-2. During the installation, the coupler buffer device enters from the out end and passes through the space to be connected with the movable portion 3 located at the inner end. Correspondingly, mounting holes for connecting the constant-force connector are provided in a side wall at the inner end of the box body 2-2. The box body 2-2 can be connected to the vehicle body 1 by welding or bolting and the like, which are all within the protection scope of the present application.

The bottom plate 2-1 can adopt many forms, such as two split plates, covering two box bodies 2-2 respectively, or an integrated U-shaped plate, including a transition plate and two cover plates, the two cover plates cover the opening at the bottom of the two box bodies 2-2 respectively, and the transition plate is connected with the inner end of the two cover plates, that is, the opening of an U-shaped plate faces the outer end.

In the coupler box provided by the specific embodiment of the present application, a main component of the movable portion 3 is an end plate 3-6, and mounting holes for connecting the constant-force connectors are also provided at two sides of the end plate 3-6, which correspond to the mounting holes arranged at the inner end of the two box bodies 2-2. The constant-force connector is at least divided into two groups, which are respectively connected with a side of the end plate 3-6 and the box body 2-2 located at the same side. An end of the constant-force connector inserts into the mounting holes of the box body 2-2, and another end of the constant-force connector inserts into the mounting holes of the end plate 3-6. The arrangement of the mounting holes can also be correspondingly adjusted according to the arrangement of the box body 2-2.

A protrusion is provided on an outer end of the end plate 3-6, which is installed in the space between the two boxes 2-2 in a normal state, and connected with the coupler buffer device. And the size of the protrusion and the space between the two box bodies 2-2 has a matching relationship, which has a guiding and position-limiting function in a moving process of the end plate 3-6.

Specifically, the constant-force connector may be multiple constant-force bolts 3-8 passing through the mounting holes, and extending directions of the constant-force bolts 3-8 are parallel to the longitudinal center line of the vehicle body 1, and multiple mounting holes in an inner end side wall of the box body 2-2 and on two sides of the end plate 3-6 are successively arranged in the vertical direction. The number of constant-force bolts 3-8 can be varied according to the situation. For example, eight constant-force bolts in total are provided, four constant-force bolts 3-8 are connected with each box body 2-2, and the number and arrangement of constant-force bolts 3-8 can also be varied according to the required preset force.

In order to facilitate the connection of the constant-force bolts 3-8, a threaded plate 3-9 is provided inside the box body 2-2, and a pad 3-7 is provided between a head of the constant-force bolts 3-8 and the inner end of the end plate 3-6, threaded holes are provided on the threaded plate 3-9 corresponding to the mounting holes, and through holes are provided on the pad 3-7 corresponding to the mounting holes. During the installation, the end plate 3-6 abuts against the box body 2-2, the threaded plate 3-9 and the pad 3-7 are respectively placed on the inner end side wall of the box body 2-2, that is, the two sides of the end plate 3-6, that is, the threaded plate 3-9 is located inside the box body 2-2 to abut against the inner end side wall, the pad 3-7 is located outside the box body 2-2 to abut against the inner end of the end plate 3-6, at the same time, the corresponding holes are coaxial and opposite, the constant-force bolts 3-8 are successively inserted, and a tail end of one constant-force bolt successively passes through a corresponding through hole of the pad 3-7, a corresponding mounting hole of the end plate 3-6 and a corresponding mounting hole of the box body 2-2, and finally is screwed into the threaded hole of the threaded plate 3-9 to realize the threaded connection. Moreover, a nut at the head of the constant-force bolt 3-8 abuts against an inner side surface of the pad 3-7, in this way, when the end plate 3-6 suffers the compression load, the force of the constant-force bolt 3-8 is transmitted to the end plate 3-6 through the pad 3-7, and a force area of the end plate 3-6 is relatively large, thus the end plate 3-6 is not easy to deform due to the force of a bolt head. The connection between the movable portion 3 and the fixing portion 2 is realized by the above method. When the tensile force is too large, the constant-force bolts 3-8 are broken, the movable portion 3 and the fixing portion 2 can be separated from each other. The connection can also be realized by adopting components such as a constant-force pin or a constant-force hook, which are all within the protection scope of the present application.

In the coupler box provided by the specific embodiment of the present application, in order to facilitate the installation of the constant-force bolts 3-8 and the removal of the constant-force bolts 3-8 in case of failure, square holes for the access of the threaded plate 3-9 can be provided at a position, corresponding to the threaded plate 3-9, of the cover plate, and at the same time, a falling prevention plate 3-4 for covering the square hole is detachably installed on the bottom plate 2-1, so as to prevent the threaded plate 3-9 from falling on the track after the failure of the constant-force bolt 3-8 and improve the safety.

On the basis of the coupler box provided in the above specific embodiments, a safety rope 3-1 is further included. Two ends of the safety rope 3-1 are respectively connected with the movable portion 3 and the fixing portion 2. When a vehicle collision occurs and the constant-force bolt 3-8 is broken, the end plate 3-6 will not fall on the track due to the pulling of the safety rope 3-1 in the movement of the end plate 3-6, which may not cause potential safety hazards.

Specifically, a safety bracket 2-4 can be provided on two sides of the square hole. A detachable connection of the safety bracket 2-4 is realized by a first pin shaft 3-2 passing through the safety bracket 2-4 and a connection hole at an end of the safety rope 3-1. Furthermore, the falling prevention plate 3-4 may also be installed on the bottom plate 2-1 through the first pin shaft 3-2. In order to prevent falling, a cotter pin 3-3 may also be provided on an end of the first pin shaft 3-2. A lifting lug 3-10 is provided on two sides of the end plate 3-6. A second pin shaft 3-5 passes through the lifting lug 3-10 and the connection hole at another end of the safety rope 3-1 to realize a detachable connection of the lifting lug 3-10.

Figure 5:
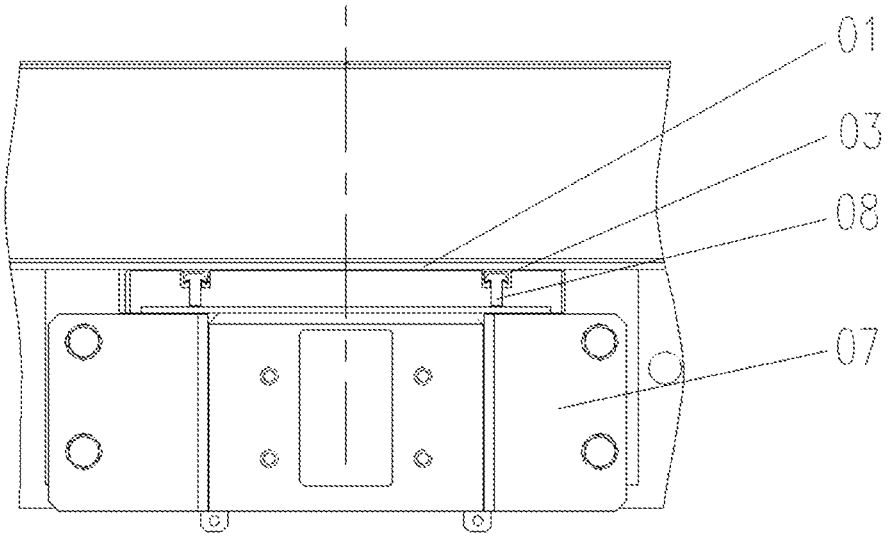
FIG. 5 is a front view and a sectional view of the specific embodiment of the coupler box according to the present application.
Figure 6:
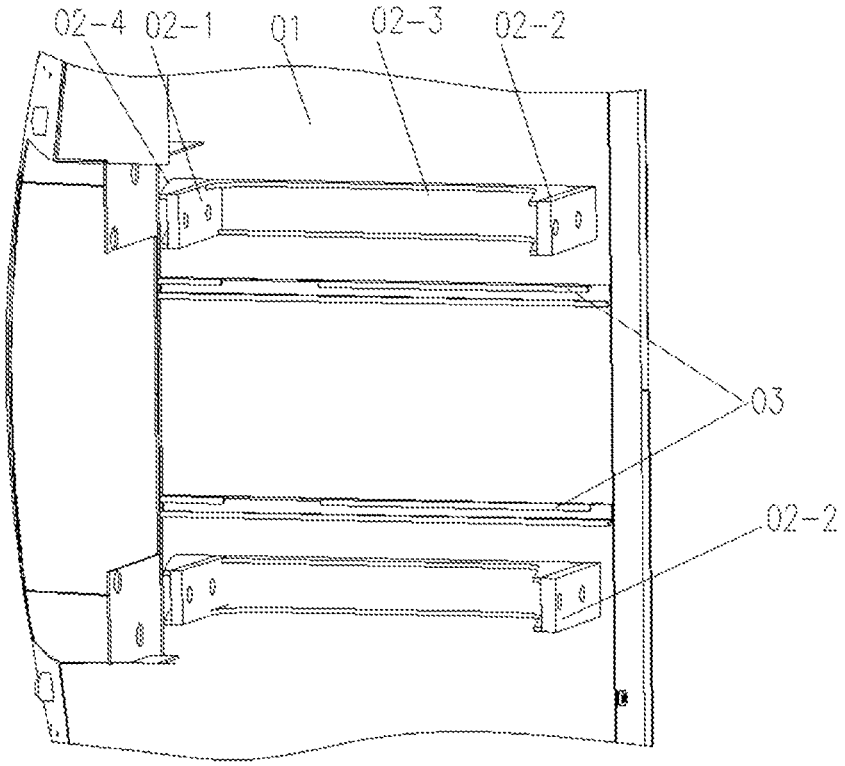
FIG. 6 is a schematic structural view of a mounting base and a sliding groove in the specific embodiment of the coupler box according to the present application.
Figure 7:
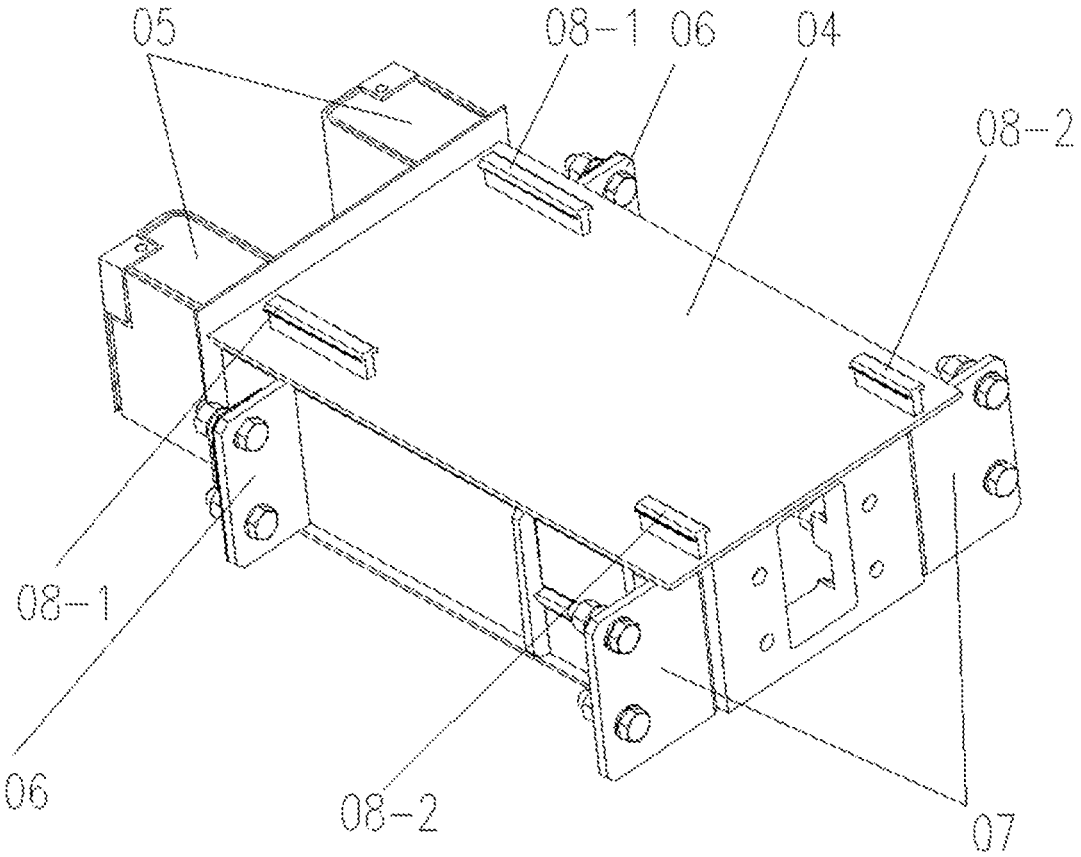
FIG. 7 is a schematic structural view of a box body in the specific embodiment of the coupler box according to the present application.

Referring to FIGS. 4 to 7, FIG. 4 is a bottom view of the specific embodiment of the coupler box according to the present application; FIG. 5 is a front view and a sectional view of the specific embodiment of the coupler box according to the present application; FIG. 6 is a schematic structural view of a mounting base and a sliding groove in the specific embodiment of the coupler box according to the present application; and FIG. 7 is a schematic structural view of a box body in the specific embodiment of the coupler box according to the present application.

The specific embodiment of the present application provides a coupler box of a rail vehicle, which includes a mounting base 02, a box body 04 and a constant-force connector. The mounting base 02 is fixedly installed at the bottom of a vehicle body 01, the box body 04 is connected with a coupler buffer device, the constant-force connector is respectively connected with the box body 04 and the mounting base 02, and the constant-force connector may be broken after a tensile force suffered by the constant-force connector is greater than a preset pressure force. An end of each component toward the end of the vehicle body 01 is defined as an outer end, and an end toward the middle of the vehicle body 01 is defined as an inner end. At the same time, a sliding groove 03 extending along the longitudinal direction thereof is provided on the bottom of the vehicle body 01, the top of the box body 04 is connected with a sliding member installed in the sliding groove 03, the sliding member can move along an extending direction of the sliding groove 03, and the sliding groove 03 prevents the sliding member from falling.

When the vehicle travels normally, a tensile force and a compressive force of the coupler buffer device are sequentially transmitted to the vehicle body 01 through the box body 04, the constant-force connector and the mounting base 02. At this time, the tensile force borne by the constant-force connector is smaller than the preset pressure, and the components are in a normal connection state, and the tensile force and the compressive force of the coupler buffer device are suffered by the coupler box. At the same time, the sliding member is installed in the sliding groove 03 to have an auxiliary hanging function, so as to prevent the box body 04 from falling.

When a rail vehicle collision, the force is continued to be transmitted to the constant-force connector after the initial energy absorption of the coupler buffer device is completed, and the box body 04 is pushed to move inward. In the case that the contact force is greater than the preset tensile force of the constant-force connector, the constant-force connector is broken, and the box body 04 of the coupler box continues moving inward along the sliding groove 03, so that the box body 04 and the mounting base 02 are separated from each other, and the coupler buffer device as a whole moves inward. The subsequent energy absorption elements of multi-level energy absorption begin to deform and absorb the energy, so as to realize the controllable sequential energy absorption of multi-level energy absorption structure at an end of the rail vehicle. At this time, the sliding member is installed in the sliding groove 03 to provide a longitudinal movement guiding and prevent falling in the vertical direction. The coupler box has a simple structure and is easy to realize, meets the collision standard, ensures the personal safety of drivers and passengers, improves the crashworthiness of the rail vehicle with the coupler buffer device, avoid the next level of energy absorption device from being hindered, which may otherwise be triggered to absorb energy, due to a not-failure of the installation structure of the coupler buffer device or a difficulty to make the installation structure of the coupler buffer device fail when a train collision occurs, and improves the safety of the equipment.

Specifically, in order to facilitate the installation of the components and balancing the components, two mounting bases 02 are included, which are symmetrically arranged on two sides of the longitudinal center line of the vehicle body 01. The box body 04 is installed between the two mounting bases 02, and connecting plates for connecting the constant-force connector are symmetrically provided on the two sides of the box body 04. Multiple constant-force connectors are divided into two groups, one group of constant-force connectors is connected with the mounting base 02 and the connecting plate on a same side, and the other group of constant-force connectors is connected with the mounting base 2 and the connecting plate on the other side. The mounting base 02 may be connected to the vehicle body 01 by welding or bolting and the like, which is all within the protection scope of the present application.

In the coupler box provided by the specific embodiment of the present application, the mounting base 02 on each side includes an outer vertical plate 02-1 and an inner vertical plate 02-2, which are sequentially arranged in the longitudinal direction of the vehicle body 01, that is, a connection line connecting the outer vertical plate 02-1 and the inner vertical plate 02-2 is parallel to the longitudinal center line of the vehicle body 01, and the outer vertical plate 02-1 is close to the end of the vehicle body 01, the inner vertical plate 02-2 is close to the middle of the vehicle body 01. A support beam 02-3 is connected between the outer vertical plate 02-1 and the inner vertical plate 02-2, and the support beam 02-3 is fixedly connected to the bottom of the vehicle body 01. A reinforcing rib 02-4 is further provided outside the outer vertical plate 02-1 to improve the strength of the equipment.

The connecting plate on each side includes an outer connecting plate 06 and an inner connecting plate 07, which are sequentially arranged in the longitudinal direction of the vehicle body 01. The outer vertical plate 02-1 and the inner vertical plate 02-2 are provided with multiple mounting holes. The outer connecting plate 06 and the inner connecting plate 07 are provided with multiple mounting holes. The multiple mounting holes on the outer vertical plate 02-1 correspond to the multiple mounting holes on the outer connecting plate 06, which are connected with each other through the constant-force connector. The multiple mounting holes on the inner vertical plate 02-2 correspond to the multiple mounting holes on the inner connecting plate 07, which are connected with each other through the constant-force connector. The number and the arrangement of connecting members can be increased according to the situation, which are within the protection scope of the present application.

Specifically, the constant-force connector may be multiple constant-force bolts 09 passing through the multiple mounting holes, and extending directions of the constant-force bolts 09 are parallel to the longitudinal center line of the vehicle body 01, and multiple mounting holes on the outer vertical plate 02-1, the inner vertical plate 02-2, the outer connecting plate 06 and the inner connecting plate 07 are sequentially arranged in the vertical direction. The number of constant-force bolts 09 can be adjusted according to the situation. For example, eight constant-force bolts 09 can be provided totally. Two mounting holes are provided on the outer vertical plate 02-1, the inner vertical plate 02-2, the outer connecting plate 06 and the inner connecting plate 07 respectively. The outer vertical plate 02-1 is connected to the outer connecting plate 06 by two constant-force bolts 09, and the inner vertical plate 02-2 is connected to the inner connecting plate 07 by two constant-force bolts 09. The number and the arrangement of constant-force bolts 09 can also be adjusted according to the required preset force. The connection can also be achieved by components such as a constant-force pin or a constant-force hook, which are all within the protection scope of the present application. Further, an adjusting gasket 010 is provided between the outer vertical plate 02-1 and the outer connecting plate 06, and, between the inner vertical plate 02-2 and the inner connecting plate 07 for eliminating the installation error.

In the coupler box provided by the specific embodiment of the present application, two impact seats 05 are arranged on the outer end of the box body 04. A space is provided at the middle of the box body 04, and the two impact seats 05 are also provided on two sides of the space. During the installation, the coupler buffer device enters from the outer end to pass through the space to be connected with the inner end of the box body 04.

On the basis of the coupler box provided by the specific embodiments, the sliding groove 03 is specifically a C-shaped groove with a downward opening, and the sliding member is specifically a T-shaped beam 08 extending in the longitudinal direction of the vehicle body 01, that is, a cross section of the T-shaped beam 08 in the vertical direction is T-shaped. A vertical portion of the T-shaped beam 08 is connected with the box body 04, and a horizontal portion of the T-shaped beam 08 is installed in the C-shaped groove. After the installation is completed, a lower end surface of the horizontal portion of the T-shaped beam 08 abuts against the lower end inner wall inside the C-shaped groove to prevent from falling.

Specifically, two C-shaped grooves are included, which are symmetrically provided on two sides of the longitudinal center line of the vehicle body 01, and two T-shaped beams 08 are provided on the top of the box body 04, which correspond to the position of the two C-shaped grooves. The number of C-shaped grooves and T-shaped beams 08 can also be adjusted according to the situation. In order to save materials, the T-shaped beams 08 can be divided into two sections, that is, an outer beam 08-1 and an inner beam 08-2 which are successively arranged in the longitudinal direction of the vehicle body 01. At the same time, an outer notch and an inner notch for the outer beam 08-1 and the inner beam 08-2 to enter the C-shaped groove horizontally are provided on the same side of the two C-shaped grooves. In order to ensure the correct installation, the length of the outer notch and the inner notch are respectively greater than the length of the outer beam 08-1 and the inner beam 08-2.

In the specific embodiment of the present application, the installation method of the coupler box is as follows. After the box body 04 is aligned with a normal assembly position in the vertical direction, the box body 04 moves a certain distance to the middle of the vehicle body 01, so that the outer beam 08-1 and the inner beam 08-2 are aligned with the outer notch and the inner notch respectively; the box body moves about half of the width of the C-shaped groove beam toward a side having the notch of the C-shaped groove; the box body 04 moves upward, and then the box body moves to the center line of the C-shaped groove beam after the vertical position is in place, that is, the outer beam 08-1 and the inner beam 08-2 are controlled to enter the C-shaped groove from the outer notch and the inner notch respectively; after the horizontal position of the box body 04 is in place, the box body 04 moves forward (in the direction of coupler) until the box body is completely in place; finally, the connecting plate is connected with the mounting base 02 through the constant-force bolts 09. In order to eliminate the manufacturing error between the connecting plate and the mounting base, the distance between the outer connecting plate 06 and the inner connecting plate 07 is smaller than the distance between the outer vertical plate 02-1 and the inner vertical plate 02-2. At the same time, the outer connecting plate 06 is located at the inner end of the outer vertical plate 02-1, that is, the outer connecting plate 06 is closer to the middle of the vehicle body 01 than the outer vertical plate 02-1, and the inner connecting plate 07 is located at the inner end of the inner vertical plate 02-2, that is, the inner connecting plate 06 is closer to the middle of the vehicle body 01 than the inner vertical plate 02-2. After the installation is completed, a gap will be generated, the gap is present at one end or at two ends, the adjusting gasket 010 is used for eliminating the gap.

In addition to the aforementioned coupler box, a rail vehicle including the above coupler box is further provided according to a specific embodiment of the present application. Reference may be made to the conventional technology for other structures of the rail vehicle, which will not be described herein.

The rail vehicle and the coupler box thereof according to the present application are described in detail hereinbefore. The principle and the embodiments of the present application are illustrated herein by specific examples. The above description of examples is only intended to help the understanding of the method and spirit of the present application. It should be noted that, for those skilled in the art, many modifications and improvements may be made to the present application without departing from the principle of the present application, and these modifications and improvements are also deemed to fall into the protection scope of the present application defined by the claims.

What is claimed is:

1. A coupler box of a rail vehicle, comprising:

a fixing portion fixedly installed on a vehicle body, and a movable portion connected with a coupler buffer device, wherein the movable portion is connected with an inner end of the fixing portion through a constant-force connector, and the constant-force connector is configured to be broken during an inward movement of the movable portion pushed by the coupler buffer device when a vehicle collision occurs, which allows the movable portion and the fixing portion to be separated from each other, wherein, the fixing portion comprises two box bodies symmetrically arranged on two sides of a longitudinal center line of the vehicle body and a bottom plate for covering an opening at a bottom of the two box bodies, a space for passing through the coupler buffer device is provided between the two box bodies, a plurality of mounting holes for connecting the constant-force connector is provided on an inner end side wall of each box body, wherein, the bottom plate comprises a transition plate and two cover plates which are integrally formed, the two cover plates cover two openings at the bottom of the two box bodies respectively, and the transition plate is connected with inner ends of the two cover plates.

2. The coupler box according to claim 1, wherein, the movable portion comprises an end plate, a plurality of mounting holes for connecting the constant-force connector is provided at two sides, correspond to the inner ends of the two box bodies, on the end plate, and, a protrusion is provided on an outer end of the end plate, which is installed in the space between the two box bodies and is connected with the coupler buffer device.

3. The coupler box according to claim 2, wherein, the constant-force connector comprises a plurality of constant-force bolts passing through the plurality of mounting holes, extending directions of the constant-force bolts are parallel to the longitudinal center line of the vehicle body, and the plurality of mounting holes on the inner end side wall of each box body and the plurality of mounting holes at two sides of the end plate are sequentially arranged along a vertical direction.

4. The coupler box according to claim 3, wherein, a threaded plate threadedly connected with an end of each constant-force bolt is provided inside the box body, and the threaded plate abut against the inner end side wall of the box body, and a pad is provided between a head of the constant-force bolt and an inner end of the end plate.

5. The coupler box according to claim 4, wherein, a square hole for an access of the threaded plate is provided at a position, corresponding to the threaded plate, of the cover plate, and a falling prevention plate for covering the square hole is detachably installed on the bottom plate.

6. The coupler box according to claim 1, further comprising a safety rope, wherein two ends of the safety rope are respectively connected with the movable portion and the fixing portion.

7. The coupler box according to claim 6, wherein, the safety rope is detachably connected with the movable portion and the fixing portion through a pin shaft and a cotter pin.

8. A rail vehicle, comprising a vehicle body and a coupler box installed on a front of a vehicle, wherein the coupler box is a coupler box according to claim 1.

9. A coupler box of a rail vehicle, comprising a mounting base fixedly installed at a bottom of a vehicle body and a box body connected with a coupler buffer device, and, two mounting bases symmetrically arranged on two sides of a longitudinal center line of the vehicle body, wherein, the box body is connected with the mounting base through a constant-force connector, the constant-force connector is configured to be broken during an inward movement of the box body pushed by the coupler buffer device when a vehicle collision occurs, which allows the box body and the mounting base to be separated from each other, a sliding groove extending in a longitudinal direction is provided at the bottom of the vehicle body, and a top of the box body is connected with a sliding member installed in the sliding groove, the sliding member is movable along an extending direction of the sliding groove, and the sliding groove prevents the sliding member from falling, wherein, the box body is installed between the two mounting bases, and a connecting plate for connecting the constant-force connector is symmetrically provided on the two sides of the box body, wherein, the mounting base on each side comprises an outer vertical plate and an inner vertical plate which are sequentially arranged in the longitudinal direction of the vehicle body, the outer vertical plate and the inner vertical plate are connected with a support beam, a plurality of mounting holes for connecting the constant-force connector is provided on the outer vertical plate and the inner vertical plate, and the connecting plate on each side comprises an outer connecting plate and an inner connecting plate which are sequentially arranged in the longitudinal direction of the vehicle body, and a plurality of mounting holes for connecting the constant-force connector is provided on the outer connecting plate and the inner connecting plate respectively corresponding to the outer vertical plate and the inner vertical plate on a same side, wherein, the constant-force connector is a plurality of constant-force bolts passing through the plurality of mounting holes, extending directions of the constant-force bolts are parallel to the longitudinal center line of the vehicle body, and the plurality of mounting holes in the outer vertical plate, the inner vertical plate, the outer connecting plate and the inner connecting plate are sequentially arranged along a vertical direction.

10. The coupler box according to claim 9, wherein, an adjusting gasket is arranged between the outer vertical plate and the outer connecting plate, and, between the inner vertical plate and the inner connecting plate.

11. The coupler box according to claim 10, wherein, two impact seats are provided on an outer end of the box body.

12. The coupler box according to claim 9, wherein, the sliding groove is a C-shaped groove with a downward opening, the sliding member is a T-shaped beam extending in the longitudinal direction of the vehicle body, a vertical portion of the T-shaped beam is connected with the box body, and a horizontal portion of the T-shaped beam is installed in the C-shaped groove.

13. The coupler box according to claim 12, comprising the two C-shaped grooves and two corresponding T-shaped beams symmetrically arranged on two sides of the longitudinal center line of the vehicle body, wherein each T-shaped beam comprises an outer beam and an inner beam sequentially arranged along the longitudinal direction of the vehicle body.

14. The coupler box according to claim 13, wherein, an outer notch and an inner notch for the outer beam and the inner beam to enter the C-shaped groove horizontally are provided on a same side of the two C-shaped groove.

* * * * *